US007559793B1

(12) United States Patent
Zhang et al.

(10) Patent No.: US 7,559,793 B1
(45) Date of Patent: Jul. 14, 2009

(54) METER SOCKET DEVICE WITH INTERCHANGEABLE METER JAW ASSEMBLY

(75) Inventors: Fan Zhang, Suwanee, GA (US); Brian J. Rusch, Suwanee, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 12/028,449

(22) Filed: Feb. 8, 2008

(51) Int. Cl.
*H01R 33/945* (2006.01)

(52) U.S. Cl. ..... 439/517

(58) Field of Classification Search ..... 439/517, 439/508, 858, 822, 843, 845, 864, 819, 852, 439/856, 861, 833, 839, 745, 747, 733.1, 439/167; 361/659, 662–669, 117, 111, 127
See application file for complete search history.

(56) References Cited

U.S. PATENT DOCUMENTS 239,645 A 7/1940 Young
4,041,358 A 8/1977 Donahue et al.
4,104,588 A 8/1978 Westberry
4,203,146 A 5/1980 Sabatella et al.
5,023,747 A * 6/1991 Lindsay ..... 361/117
5,657,200 A 8/1997 Leach et al.
5,980,311 A 11/1999 Campbell et al.
6,325,666 B1 * 12/2001 Robinson et al. ..... 439/517
6,561,844 B1 * 5/2003 Johnson ..... 439/507
2008/0081510 A1 * 4/2008 Porter et al. ..... 439/517

* cited by examiner

*Primary Examiner*—Edwin A. Leon
(74) *Attorney, Agent, or Firm*—Jose de la Rosa

(57) ABSTRACT

The invention provides a meter socket assembly for a watt-hour meter with removable and changeable meter jaws. The meter socket assembly comprises a meter base, at least one meter jaw assembly with two optional $5^{th}$ terminal provisions. The assemblies are snapped on to the meter base and locked into the meter base. Any meter jaw assembly in the meter socket device is able to be removed or changed by simply loosening a connection nut and then releasing the meter jaw assembly by pressing a cross locking tab. The meter base, mounted to enclosure of a meter socket device or a meter socket module, is also changeable. The meter socket device is suitable for a meter socket with line and load busing connections, especially modular metering devices.

14 Claims, 7 Drawing Sheets

METER SOCKET DEVICE WITH INTERCHANGEABLE METER JAW ASSEMBLY

FIELD

This invention relates to a watt-hour meter socket device or modular (group) metering devices. In particular, this invention relates to a meter socket assembly having an interchangeable meter jaw assembly for use with a watt-hour meter.

BACKGROUND

Socket type electrical watt-hour meters are used to measure and indicate the amount of electrical power consumption in a residence, industry or business. Typically, a socket type watt-hour meter plugs into a meter socket using a blade-like stab or meter blade connector located on the watt-hour meter. The meter socket itself is mounted inside a meter base or a panel. A meter socket commonly has a spring loaded receptacle-like jaw to receive and contact the watt-hour meter blade insertion. The meter jaw and spring provide enough force to press meter blade and conduct electricity while maintaining a certain current load and a heat rise.

The line side of a meter socket is connected to the utility electrical power source, while the load side of a meter socket is connected to the tenant. A watt-hour meter is inserted onto the meter jaws on a meter socket to bridge the line and load making the electrical connection between the utility power source and the tenant. In the industry, spring tempered copper meter jaws are mounted on meter sockets to receive plug-in watt-hour meters. Due to limited spacing and special application, the meter jaws carry high current density and have less contact surface area. Therefore, the contact surface may be weak for electrical connection between a meter jaw and a watt-hour meter blade, a meter jaw and its mount connector, and a meter jaw itself. This is evident in modular metering devices, which have heavier line and load buses and stronger bounding bus connections. Such weak positions with electrical connection make the components of meter jaw assemblies prone to damage during a power surge or electrical interruption. From a time saving perspective, it would be more beneficial to be able to change an individual front removable and replaceable meter jaw assembly on a meter socket or even replace a whole meter socket in modular metering devices whenever a meter jaw assembly or a meter socket is damaged, rather than replacing the whole meter box device.

Meter jaw alignment is another factor that affects meter socket performance conducting electricity. Meter jaw misalignment is caused by tolerance built-up in multiple components in fabrication and during the assembly process. In the field, meter jaw misalignment may cause service and reliability issues. A meter socket with misaligned meter jaws or meter jaw assemblies make installing a watt-hour meter more difficult. There will be connection issues for conduction of electricity. For example, a twisted, deformed or even damaged meter jaw may cause extensive heat on meter jaws.

Therefore there is a need for improvement in meter sockets and in particular meter jaw assemblies.

There is also a need to provide a robust meter socket base to assist precise meter jaw alignment with their mounting plates.

OBJECT

In accordance with this invention, a meter socket device for an electrical meter box comprising: a meter socket base; and at least one interchangeable meter jaw assembly wherein the meter jaw assembly locks into the meter socket base fastenerless.

In accordance with another aspect of this invention, an interchangeable meter jaw assembly for an electrical meter box comprising: a mounting plate; a meter jaw for contacting a meter blade of a watt hour meter fastened to the mounting plate; and an insulating guide attached to the meter jaw for protection from contact. In accordance with another aspect of this invention, A method of retaining at least one interchangeable meter jaw assembly on a meter socket base in an electrical meter box, the steps comprising: providing an interchangeable meter jaw assembly; providing a meter socket base with at least one receiving slot wherein the receiving slot includes means for receiving and locking the interchangeable meter jaw assembly fastenerless; sliding the interchangeable meter jaw assembly to stop position; and fastening the mounting plate to an electric connect.

In accordance with another aspect of this invention, a method of interchanging meter jaws, the steps comprising: loosening a fastener of a mounting plate; pressing a cross locking tab; and sliding a meter jaw assembly out. In accordance with another aspect of this invention, A method of meter jaw alignment in an electrical meter box, the steps comprising: providing a meter jaw; providing a meter jaw mounting plate; affixing meter jaw to meter jaw mounting plate; affixing meter jaw mounting plate to a meter socket base; providing a mounting plate wherein the mounting plate is shaped to be locked in position for supported meter jaw and keeping jaw alignment; and providing mounting plate with means for centering. One objects of this invention is to provide a robust meter socket with individually front removable and replaceable meter jaw assemblies and $5^{th}$ terminal provision. Another of the objects is to provide a meter socket base on which meter jaw assemblies are able to be easily replaced and retained.

A further object is to provide a meter socket with built in features for precise meter jaw alignment.

BRIEF DESCRIPTION OF DRAWINGS

FIG. 4 *b*) is an enlarged view of a detached meter jaw assembly with mounting plate.

DETAILED DESCRIPTION

Figure 1:
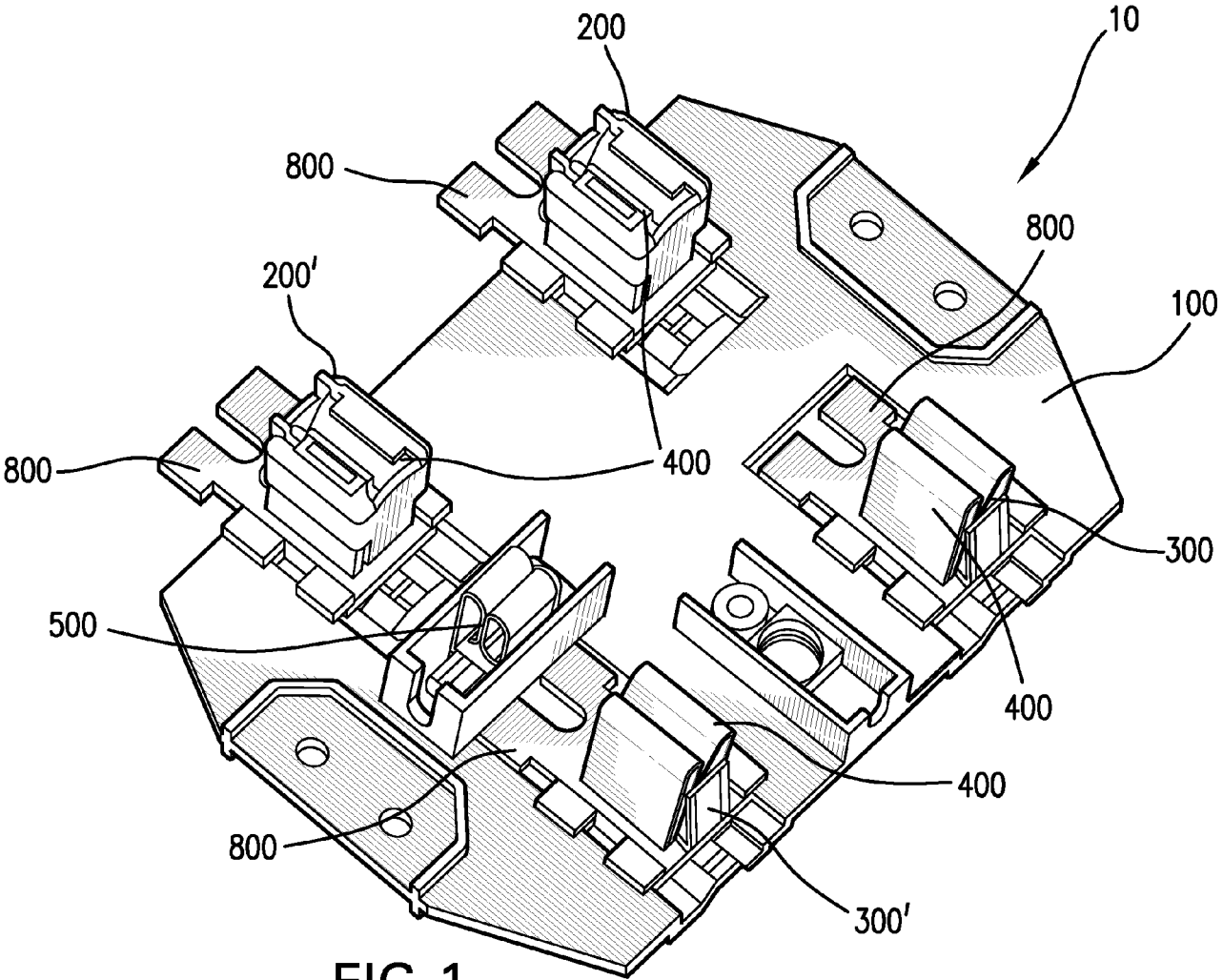
FIG. 1 is a perspective view of a meter socket device with front removable meter jaw assemblies.

FIG. 1 shows a meter socket device 10 as described in this invention. The meter socket device 10 comprises a meter socket base 100, a pair of line meter jaw assemblies 200 and 200', a pair of load meter jaw assemblies 300 and 300', and an optional $5^{th}$ terminal assembly 500. The line meter jaw assemblies 200 and 200' and the load meter jaw assemblies 300 and 300' are collectively called the meter jaw assemblies 400. The meter jaw assemblies 400 are installed and removed from the meter socket base 100 by simply releasing the cross locking tab 600 shown in FIG. 7 located on the meter socket base 100. The cross locking tab 600 fastens and holds the end of the meter jaw mounting plate 800 of the meter jaw assemblies 400. This will be described further in FIG. 6.

Figure 2:
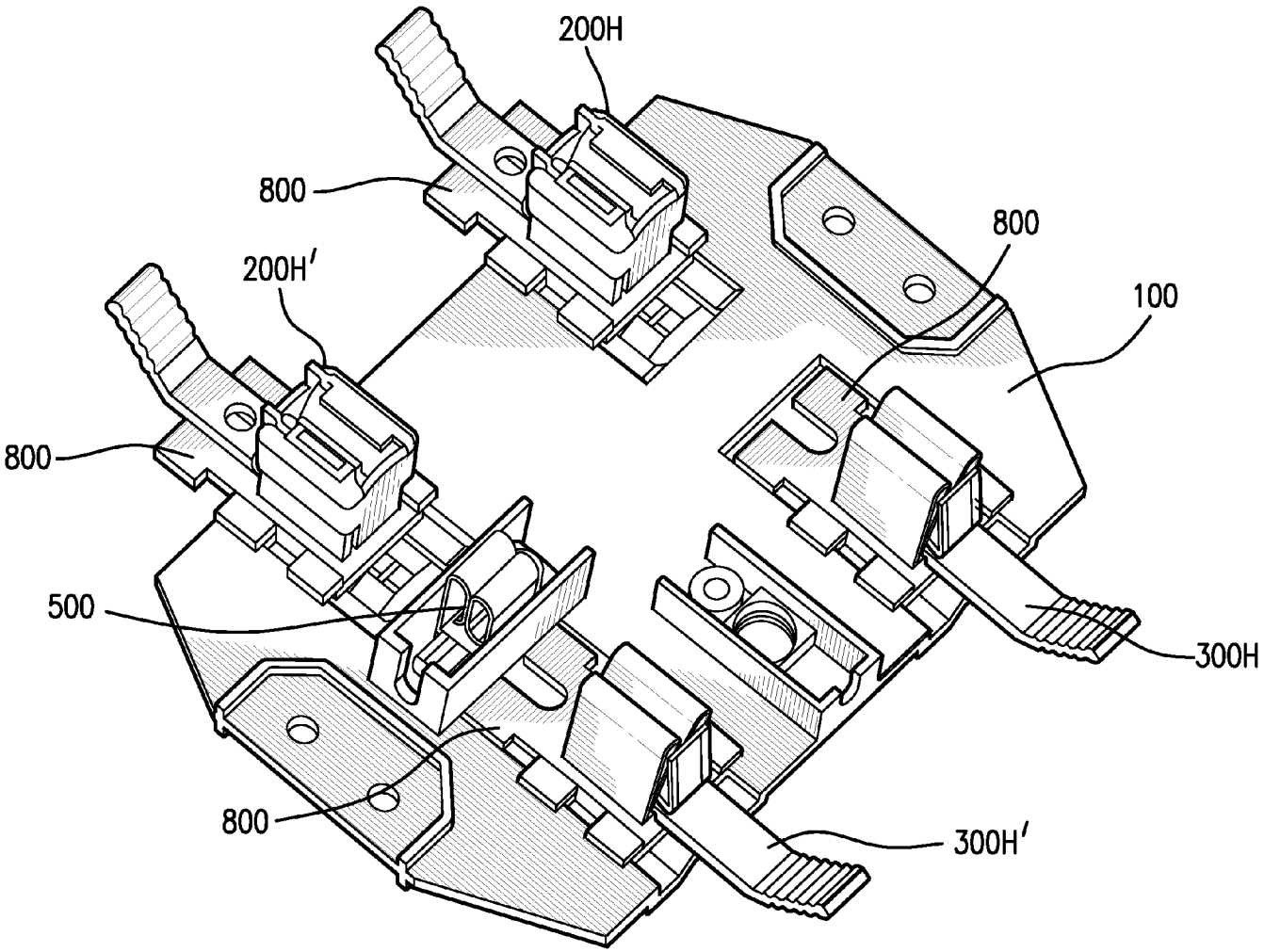
FIG. 2 is a perspective view of an alternative configuration of the meter socket device with front removable jaw assemblies and horn by-pass.

FIG. 2 shows an alternative embodiment of meter socket assembly 10 with a horn by-pass installed. The horn by-passes are installed on load meter jaw assemblies 300H and 300H', while the horn by-passes are installed separately on the meter jaw mounting plates 800 of the line jaw assemblies 200 and 200' of the meter socket assembly. The line and load horn by-passes, optional for ringless type metering devices, are connect to a manual by-pass cable which wilt by-pass a watt-hour meter. A horn by pass is used in cases where electrical power has to be supplied continuously when the watt-hour meter is to be removed for maintenances or upgrades, for example, an emergency room or a situation where medical conditions demand continuous electrical power.

Figure 3:
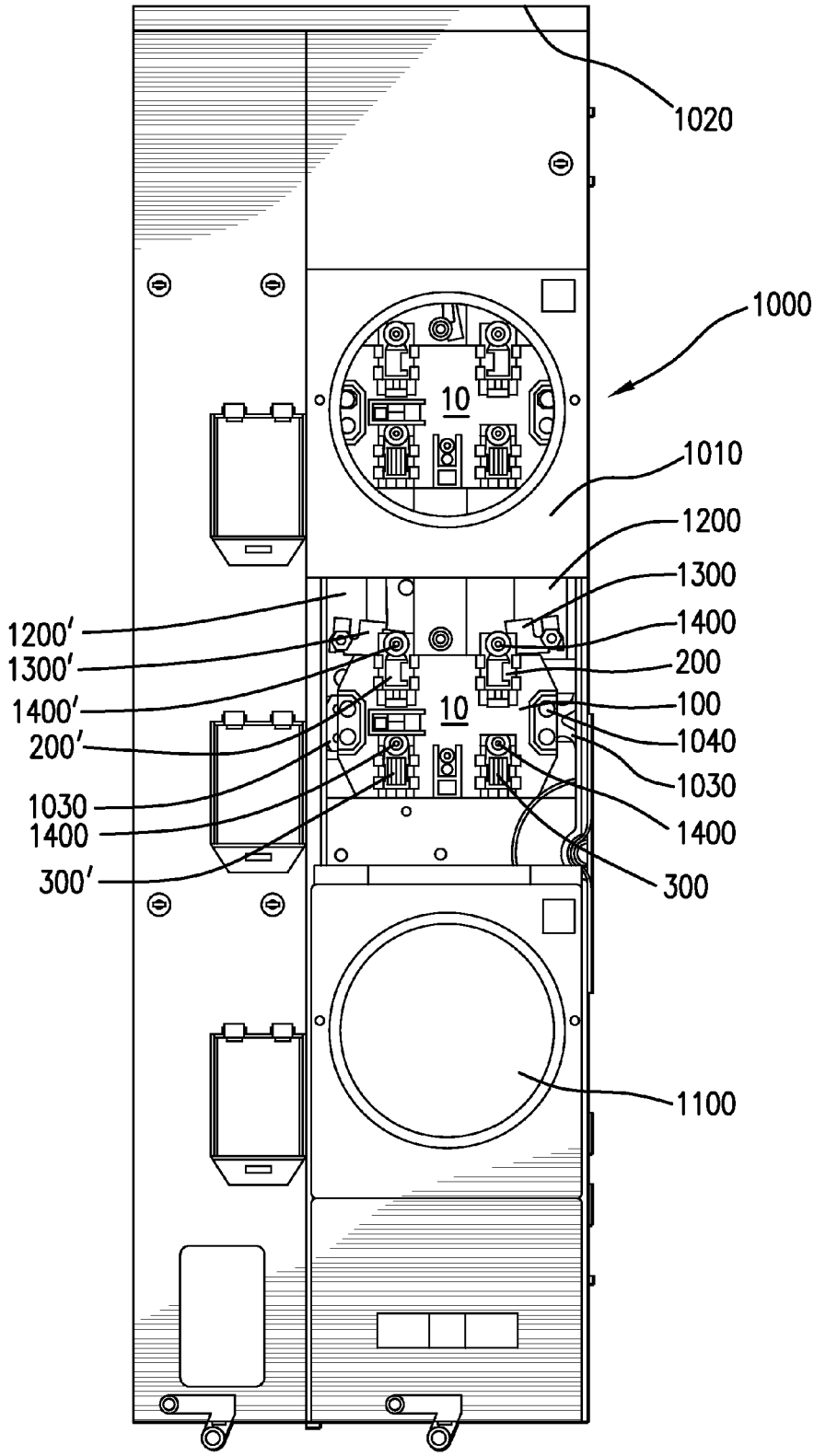
FIG. 3 is a front view of a modular metering device with the meter socket device installed.

FIG. 3 shows a ring type modular metering device 1000 that has the meter socket assemblies 10 installed. The meter socket assemblies 10 are mounted inside the enclosure 1020 and covered by meter covers 1010, while the center of the meter cover align with the center of the meter socket device 10 so that a watt-hour meter (not shown but standard in the art) may be installed onto the meter socket assembly 10 through a meter cover opening. The meter cover 1010 and protective cardboard cover 1100 were blanked in order to see the interior components. The meter socket assembly 10 is mounted to the enclosure 1020 on a pair of mounting brackets 1030 with fasteners 1040. The line meter jaw assembly 200 and 200' is connected to a riser bus 1200 and 1200'. The riser bus 1200 and 1200' links to the line electrical power, through the line strap 1300 and 1300" joined with a fastener 1400. The load meter jaw assembly 300 and 300' is connected to load strap (not shown but standard in the art), which leads to load tenant, by a fastener 1400. Therefore, whenever a line meter jaw assembly 200 and 200' or a load meter jaw assembly 300 and 300' needs to be replaced, only one fastener 1400 needs to be loosened to retrieve the line meter jaw assembly 200 and 200' or the load meter jaw assembly 300 and 300'. Once a new line meter jaw assembly 200 and 200' or a load meter jaw assembly 300 and 300' has been installed, the appropriate fastener 1400 must be tightened to a specified torque to complete installation.

Figure 4A:
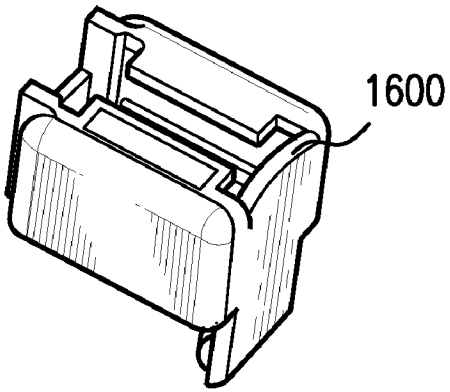
FIG. 4 *a*) is an enlarged view of an insulating meter jaw guide.
Figure 4B:
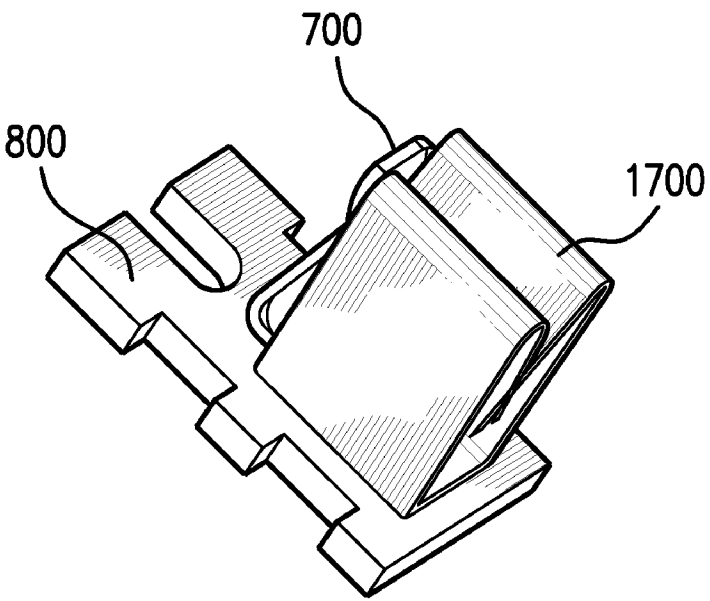

FIG. 4 *a*) is an enlarged view of an insulating meter jaw guide 1600 that may be fastened onto either the line meter jaw assembly 200 and 200' or the load meter jaw assembly 300 and 300' to provide protection from accidental contact.

FIG. 4 *b*) shows an enlarged view of a line meter jaw assembly 200 and 200' or a load meter jaw assembly 300 and 300'. The meter jaw 1700, the metal meter jaw spring guide 700 and the meter jaw mounting plate 800 are assembled together with a fastener from the bottom of the meter jaw mounting plate 800 (not shown due to the orientation of the view). The special shape of the meter jaw mounting plate 800 is designed to fit in the meter socket base 100 and to be locked in position for supporting meter jaw 1700 and keeping jaw alignment.

Figure 5:
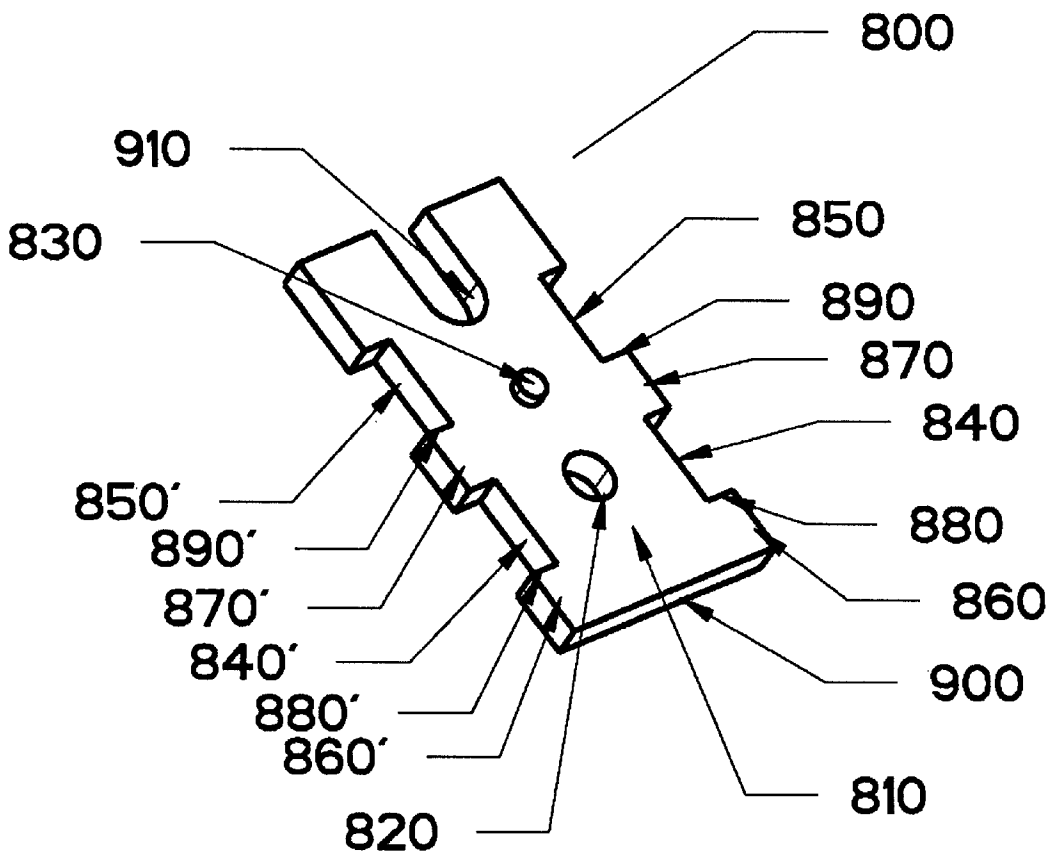
FIG. 5 is a perspective view of the meter jaw mounting plate.

FIG. 5 shows the detail of the meter jaw mounting plate 800. In the line meter jaw assembly 200 and 200' or the load meter jaw assembly 300 and 300', a meter jaw 1700 stands on the top surface 810 of the meter jaw mounting plate 800 and is mounted through the aperture 820. The halfshear (or emboss) 830 on the top surface 810 fits into a slot at the bottom of a meter jaw 1700 to guide the center line of the meter jaw 1700 aligning it with the center line of the meter jaw mounting plate 800. The first side slots 840 and 840' and the second side slots 850 and 850' are precisely fabricated to fit in the holding pads 2200 shown in FIG. 7 and mate with the side guide features 2400 in order to control the alignment of either the line meter jaw assembly 200 and 200' or the load meter jaw assembly 300 and 300'. The first extended fins 860 and 860' and the second extended fins 870 and 870' inserted into the holding slots 2500 in FIG. 7 of a meter jaw pocket 2100 (see FIG. 6). The first end surfaces 880 and 880' and second end surfaces 890 and 890' of the first and second extended fins 860 and 860'; 870 and 870' respectively are directly against the close ends 2600 of the meter jaw assembly holding slots 2500 (shown in FIG. 7) when one of meter jaw assemblies 400 is installed. The cross locking tab 600 in FIG. 7 will lock the end surface 900 of the meter jaw mounting plate 800. The open "U" shaped slot 910 is to receive a fastener 1400 as shown in FIG. 3 from the connection bus to build electrical connection, and allows one of the meter jaw assemblies 400 to slide off from the opening end of the slot 910 by loosening the fastener 1400 whenever one of meter jaw assemblies 400 needs to be replaced.

Figure 6:
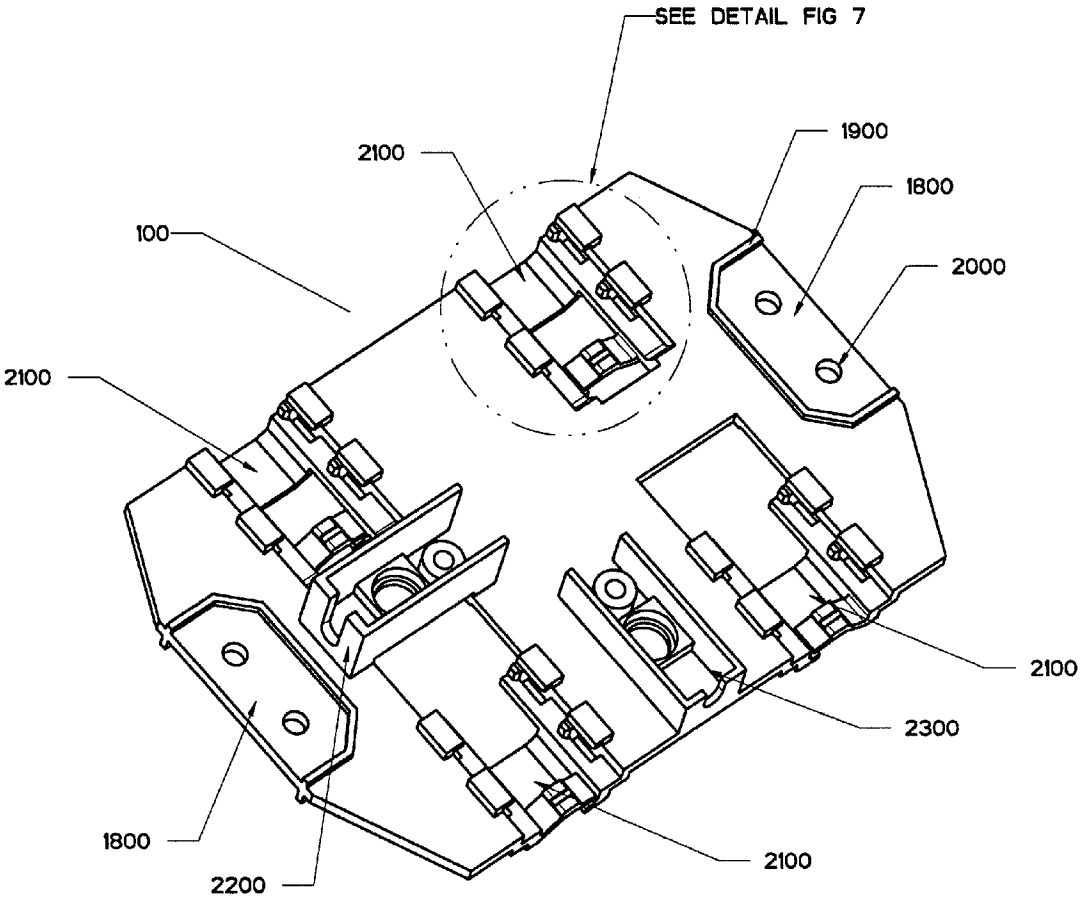
FIG. 6 is a perspective view of the meter socket base.

FIG. 6 shows the meter socket base 100. The mounting area 1800 surrounded by barreling wall 1900 mount to enclosure 1020 and ring type meter covers 1010 in FIG. 3 or ringless meter support bracket (not shown). Four mounting holes 2000 are provided for robust and firm joint to withstand the force of the insertion and extraction of a watt-hour meter. There are four receiving slots 2100 for receiving line meter jaw assemblies 200 and 200' or load meter jaw assemblies 300 and 300' in a meter socket assembly 10. Six o'clock position $5^{th}$ terminal 2100 and nine o'clock position $5^{th}$ terminal 2200 provisions are provided for alternative $5^{th}$ terminal connection.

Figure 7:
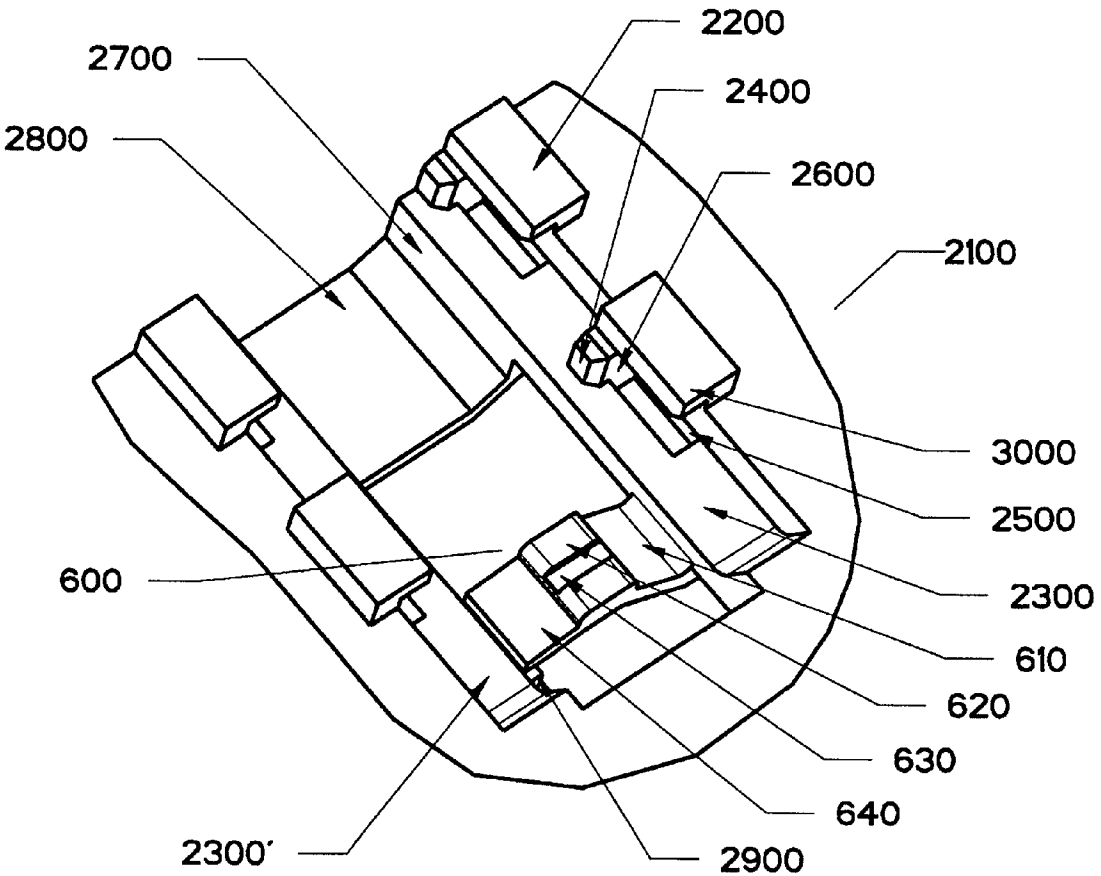
FIG. 7 is a perspective view of the receiving slot on the meter socket base.

FIG. 7 shows a detailed view of receiving slot 2100 for one of meter jaw assemblies 400. When installing one of meter jaw assemblies 400 to the meter socket base 100, one of meter jaw assemblies 400 is fitted in between the holding pads 2200 and laid on the sliding platform 2300 and 2300' with the guiding features 2400 directly against the first and second slots 840 and 840'; 850 and 850' on the meter jaw mounting plate 800. The tolerance between the guiding features 2400 is tight so that the clearances between the guiding features 2400 and the first and second slots 840 and 840'; 850 and 850' on the meter jaw mounting plate 800 are precisely controlled. This enables one of the meter jaw assemblies 400 to slide by and prevents a meter jaw assembly 400 from rattling. While the cross locking tab 600 is pressed down, a meter jaw assembly 400 may slide in under the holding pads 2200 and against the close end 2600. The end surface 900 of the meter law mounting plate 800 passes the cross locking tab 600, then the cross locking tab 600 rebounds back and blocks on the end surface 900 of a meter jaw assembly 400 from moving back. The cross locking tab 600 includes three portions: the flex link 610, the locking pad 620, and the extension 640. The flex link 610, rooted on the back side of the sliding platform 112 and 112', is a thin strip of a diagonal bridge 630 and 2300 that extends to the middle of the receiving slot 2100. The top surface of the locking pad 620 is above the surface of the sliding platform 2300 and 2300' to block the end surface 900 of the meter jaw mounting plate 800 when a meter jaw assembly 400 is installed. The slot 630 on the locking pad 620 allows a screw driver or the like to press down on the cross locking tab 600 for releasing an assembled meter jaw assembly 400. The extension 640 paired with stop tab 2900 is a protection feature that prevents the cross locking tab 600 from over travel and damage when the locking pad 620 is pressed to release an installed meter jaw assembly 400. Between the end walls 2700 and the top of the supporting link 2800, the open receiving slot is to clear the sliding path for installing and removing a meter jaw assembly 400. The supporting link 2800 also links the opening end of the open receiving slot to strengthen the meter socket base 100.

While the foregoing description and drawings represent the preferred embodiments of the present invention, it will be apparent to those skilled in the art that various changes and modifications may be made therein without departing from the true spirit and scope of the present invention.

What is claimed is:

1. A meter socket for an electric meter enclosure comprising:

a meter socket base having a front face and at least one jaw pocket oriented transverse and generally parallel to the front face, the jaw pocket defining a receiving slot and a cross locking tab, the tab translatable from a first position enabling access to the receiving slot to a second position blocking access to the receiving slot; and at least one meter jaw having a mounting plate that is slidably engageable within the receiving slot when the locking tab is in the first position and thereafter retained within the slot when the locking tab is in the second position.

2. The meter socket of claim 1, wherein the jaw pocket and cross locking tab are integrally formed within the meter socket base.

3. The meter socket of claim 1, wherein the locking tab is biasable from the second position to the first position.

4. The meter socket of claim 1, wherein the jaw pocket defines holding pads to retain the jaw mounting plate within the receiving slot.

5. The meter socket of claim 1 further comprising four jaw pockets and corresponding meter jaws.

6. The meter socket of claim 5 further comprising a fifth terminal.

7. The meter socket of claim 1 further comprising an electrical insulating guide coupled to the meter jaw.

8. A meter socket for an electric meter enclosure comprising:

a meter socket base having a front face and at least one jaw pocket oriented transverse and generally parallel to the front face, the jaw pocket defining a receiving slot and a biased, integrally formed cross locking tab, the tab translatable from a first position enabling access to the receiving slot to a second position blocking access to the receiving slot; and a meter jaw having a mounting plate that is slidably engageable within the receiving slot when the locking tab is in the first position and thereafter retained within the slot when the locking tab is in the second position.

9. The meter socket of claim 8, wherein the locking tab is biasable from the second position to the first position.

10. The meter socket of claim 8, wherein the jaw pocket defines holding pads to retain the jaw mounting plate within the receiving slot.

11. The meter socket of claim 8 further comprising four jaw pockets and corresponding meter jaws.

12. The meter socket of claim 8 further comprising a fifth terminal.

13. The meter socket of claim 8 further comprising an electrical insulating guide coupled to at least one meter jaw.

14. In a meter socket for an electric meter enclosure including a meter socket base having a front face and at least one jaw pocket oriented transverse and generally parallel to the front face, the jaw pocket defining a receiving slot and a cross locking tab that is translatable from a first position enabling access to the receiving slot to a second position blocking access to the receiving slot and a meter jaw having a mounting plate that is slidably engageable within the receiving slot, a method for inserting a meter jaw comprising:

translating the locking tab to its first position;

slidably inserting the mounting plate into the receiving slot; and translating the locking tab to its second position.

* * * * *